US006362405B2

(12) United States Patent
Koseki et al.

(10) Patent No.: US 6,362,405 B2
(45) Date of Patent: Mar. 26, 2002

(54) HYBRID MUSICAL INSTRUMENT EQUIPPED WITH STATUS REGISTER FOR QUICKLY CHANGING SOUND SOURCE AND PARAMETERS FOR ELECTRONIC TONES

(75) Inventors: Shinya Koseki; Haruki Uehara, both of Shizuoka (JP)

(73) Assignee: Yahama Corporation (JP)

( * ) Notice: Subject to any disclaimer, the term of this patent is extended or adjusted under 35 U.S.C. 154(b) by 0 days.

(21) Appl. No.: 09/756,580

(22) Filed: Jan. 8, 2001

(30) Foreign Application Priority Data

Jan. 12, 2000 (JP) ..... 2000-003959

(51) Int. Cl.[7] ..... G10F 1/01
(52) U.S. Cl. ..... 84/2; 84/19; 84/171; 84/622
(58) Field of Search ..... 84/2, 19–21, 170–172, 84/615, 622, 653, DIG. 6

(56) References Cited

U.S. PATENT DOCUMENTS 4,744,281 A * 5/1988 Isozaki ..... 84/171 X
5,461,192 A 10/1995 Imaizumi ..... 84/634
5,463,184 A * 10/1995 Kawamura ..... 84/171 X
5,583,310 A * 12/1996 Sugiyama et al. ..... 84/2 X
5,652,403 A * 7/1997 Sugiyama et al. ..... 84/171 X
5,741,995 A * 4/1998 Kawamura et al.
5,824,930 A * 10/1998 Ura et al. ..... 84/171 X
5,880,389 A * 3/1999 Muramatsu ..... 84/615
5,908,997 A 6/1999 Arnold et al. ..... 84/615

* cited by examiner

*Primary Examiner*—Jeffrey Donels
(74) *Attorney, Agent, or Firm*—Ostrolenk, Faber, Gerb & Soffen, LLP

(57) ABSTRACT

A hybrid keyboard musical instrument includes two electric tone generators, music strings selectively struck with hammers driven for rotation by action mechanisms and a silent system for changing a hammer stopper between a free position and a blocking position, and a controlling system supplies instructions for changing the hammer stopper to the silent system and parameters for electronic tones to the tone generators, wherein a user registers pieces of status information in a hard disk unit, and selectively calls the pieces of status information from the hard disk unit during a performance by manipulating buttons so that the user quickly changes the status of the hybrid keyboard musical instrument.

23 Claims, 9 Drawing Sheets

| REGISTER BUTTON | ACOUSTIC PIANO | ELECTRIC SOUND GENERATING SYSTEM | | | | | |
|---|---|---|---|---|---|---|---|
| | HAMMER STOPPER | PIANO TONE GENERATOR | PARAMETERS FOR GENERAL TONE GENERATOR | | | | |
| | | | TIMPLE | volume | expression | pan | ..... |
| A | FREE POSITION | OFF | 128 | ..... | ..... | ..... | ..... |
| B | BLOCKING POSITION | ON | 128 | ..... | ..... | ..... | ..... |
| C | ditto | OFF | 128 | ..... | ..... | ..... | ..... |
| D | FREE POSITION | ON | 30 | ..... | ..... | ..... | ..... |
| E | ditto | ON | 20 | ..... | ..... | ..... | ..... |
| F | BLOCKING POSITION | ON | 32 | ..... | ..... | ..... | ..... |
| G | ditto | OFF | 43 | ..... | ..... | ..... | ..... |
| H | FREE POSITION | OFF | 51 | ..... | ..... | ..... | ..... |
| I | ditto | OFF | 60 | ..... | ..... | ..... | ..... |
| J | ditto | ON | 75 | ..... | ..... | ..... | ..... |
| K | ditto | ON | 90 | ..... | ..... | ..... | ..... |
| L | BLOCKING POSITION | ON | 5 | ..... | ..... | ..... | ..... |
| M | ditto | ON | 80 | ..... | ..... | ..... | ..... |

Fig. 3

HYBRID MUSICAL INSTRUMENT EQUIPPED WITH STATUS REGISTER FOR QUICKLY CHANGING SOUND SOURCE AND PARAMETERS FOR ELECTRONIC TONES

FIELD OF THE INVENTION

This invention relates to a hybrid musical instrument and, more particularly, to a hybrid musical instrument between an acoustic musical instrument and an electric musical instrument.

DESCRIPTION OF THE RELATED ART

The hybrid keyboard musical instrument selectively generates acoustic piano tones and electronic tones, and is known as "silent piano". The silent piano is fabricated on the basis of an acoustic piano. A hammer stopper, key sensors, a controller and a sound system are installed in the acoustic piano. The hammer stopper laterally extends between the rest positions of hammers and the music strings, and the controller changes the hammer stopper between a free position and a blocking position. The hammer stopper is located in the trajectories of the hammer shanks in the blocking position, and the hammers rebound on the hammer stopper before striking the music strings. For this reason, the music strings do not vibrate. This means that any acoustic piano tone is not generated. On the other hand, the hammer stopper is out of the trajectories of the hammer shanks in the free position, and permits the hammers to strike the music strings.

While a pianist is playing, a tune on the keyboard, the hammers are selectively driven for rotation, and strike the associated music strings. The music strings vibrate for generating the acoustic piano tones. The key sensors periodically report the current key positions to the controller, and the controller determines the note number assigned to each of the depressed/released keys, and calculates the key velocity. The controller stores the note number, the key velocity and the lapse of time between the key motions in music data codes, and produces the audio signal from the series of music data codes. For this reason, the electronic tones are generated along the tune. The performance through the acoustic piano tones and the performance through the electronic tones are hereinbelow referred to as "acoustic sound mode" and "electric sound mode", respectively.

The instructions are given through a manipulating panel to the controller. One of the switches on the manipulating panel is assigned to the instruction to change the hammer stopper from the free position to the blocking position and vice versa. A set of switches on the manipulating panel is assigned to selection of a timbre imparted to the electronic tones.

Another hybrid keyboard musical instrument also generates the electronic tones or the acoustic tones depending upon the instructions given through the manipulating panel. The hybrid keyboard musical instrument permits a pianist and the sound system to perform an ensemble. When a user instructs an ensemble to the controller, the controller changes the hammer stopper to the free position, and vacates the trajectories of the hammer shanks.

While the user is playing a tune on the keyboard, the music strings are sequentially struck with the associated hammers for generating the acoustic piano tones in a part of a music score, and the controller supplies the audio signal to the sound system for generating the electronic tones in another part of the music score. The performance through both acoustic and electronic tones is hereinbelow referred to as "ensemble mode".

The user is assumed to establish one of the three modes of operation, i.e., the acoustic sound mode, the electric sound mode, and the ensemble mode in the prior art hybrid keyboard musical instrument before the performance. The user changes the hammer stopper to the appropriate position, and gives parameters to the controller. The controller gets ready for the selected mode of operation before the initiation of fingering on the keyboard. The user can concentrate his attention on the fingering during the performance.

A user may want to change the mode operation in the middle of a performance. The manipulation of switches on the panel is required for the change of the mode. The user diverts the attention from the fingering on the keyboard, and manipulates the switches on the manipulating panel appropriately. The user can not concentrate the attention on the fingering, and feels the change of mode difficult.

SUMMARY OF THE INVENTION

It is therefore an important object of the present invention to provide a hybrid musical instrument, which allows a user to change the mode of operation easily.

In accordance with one aspect of the present invention, there is provided a musical instrument comprising plural sound generating sources each independently activated for producing tones from pieces of music data information and deactivated for keeping itself silent, each of the combinations of the activated sound generating sources establishing one of different kinds of status in the musical instrument, a data source producing the pieces of music data information available for producing tones through each of the plural sound generating sources, a data storage having plural storage areas, a registrar producing, pieces of status information representative of the different kinds of status, respectively, and connected to the data storage for storing the pieces of status information in the plural storage areas, respectively, and a recalling means having plural manipulators respectively representative of the pieces of status information stored in the data storage and establishing each of the different kinds of status in the musical instrument when associated one of the plural manipulators is manipulated.

BRIEF DESCRIPTION OF THE DRAWINGS

The features and advantages of the hybrid musical instrument will be more clearly understood from the following description taken in conjunction with the accompanying drawings in which:

FIG. 3 is a view showing, an example of control sequence stored in a hard disk driver;

DESCRIPTION OF THE PREFERRED EMBODIMENTS

Structure of Hybrid Keyboard Musical Instrument

Figure 1:
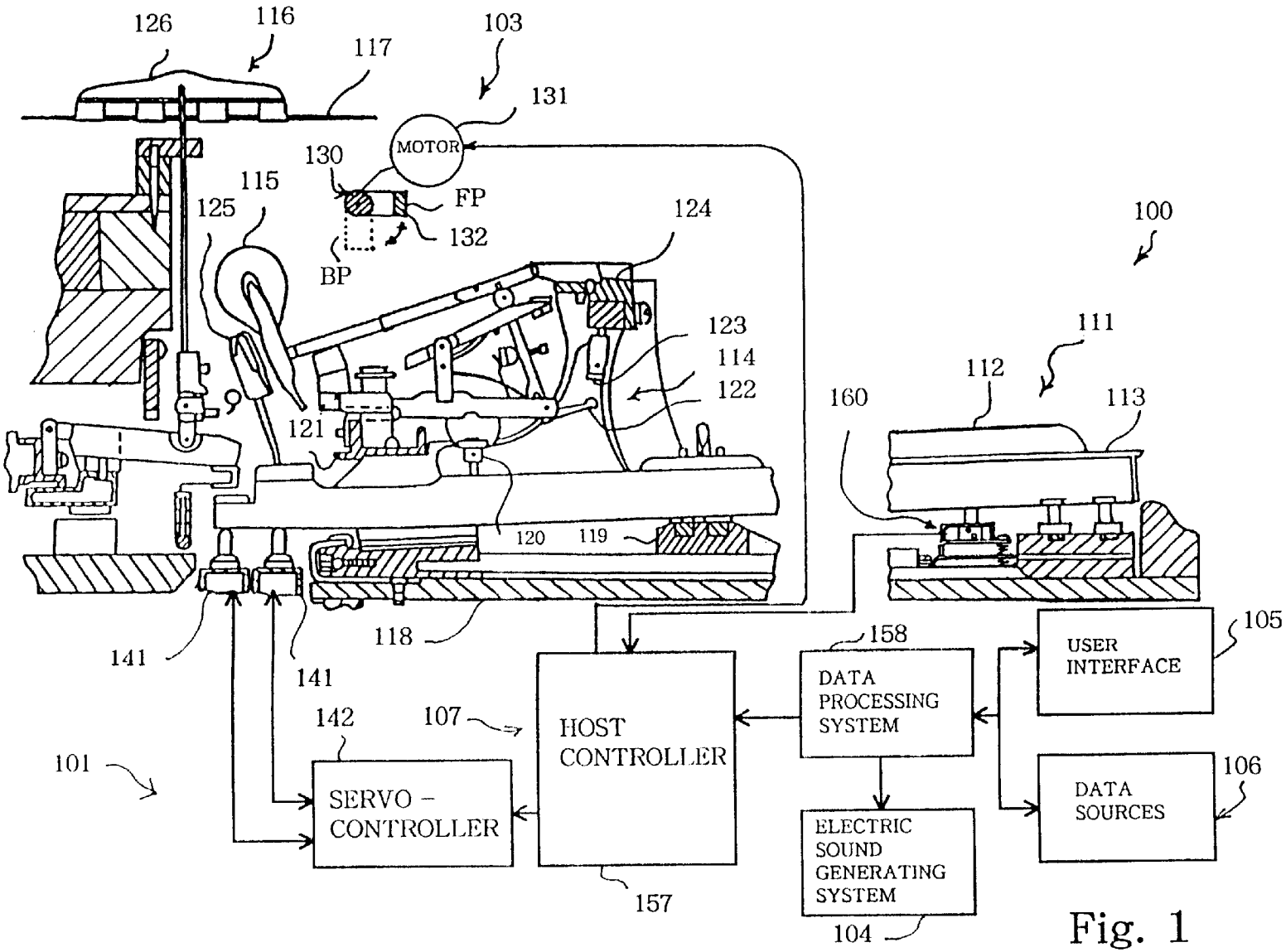
FIG. 1 is a cross sectional view showing, the structure of a hybrid keyboard musical instrument according to the present invention.

Referring to FIG. 1 of the drawings, a hybrid keyboard musical instrument largely comprises an acoustic piano 100, an automatic playing system 101, a silent system 103 an electric sound generating system 104, a user interface 105, data sources 106 and a controlling system 107. The hybrid keyboard musical instrument generates acoustic piano tones through the acoustic piano 100 in and electronic tones through the electronic sound generating system l04. The acoustic piano 100 and the electric sound generating system 104 performs an ensemble or concurrently generate the acoustic piano tones and the electronic tones. The controlling system 107 changes the performance between a solo performed through the acoustic piano 100, a solo performed through the electronic sound generating system 104, an ensemble between the acoustic piano 100 and the electronic sound generating system 104 and a concurrent tone generation without complicated manipulation on the user interface 105 in the performance. The hybrid keyboard musical instrument selectively plays the solos in a solo mode of operation and the ensemble in an ensemble mode. Otherwise, the hybrid keyboard musical instrument concurrently generates the acoustic piano tones and the electronic tones in a concurrent mode.

In the following description, a word "front" is indicative of a relative position closer to a user playing the acoustic piano than a "rear position". A virtual line drawn between a front position and an associated rear position extends in "fore-and-aft direction", and a word "lateral" is indicative of the direction perpendicular to the fore-and-aft direction.

The acoustic piano 100 is a standard grand piano. A keyboard 110 is incorporated in the acoustic piano 100, and black keys 112 and white keys are arranged in the lateral direction. The automatic playing system 101 sequentially moves the black keys 112 and the white keys 113 without fingering, and plays a tune on the keyboard 111. The silent system changes the acoustic piano 100 between a silent mode and an acoustic sound mode. The silent system 103 permits a pianist or the automatic playing system 101 to play a tune through acoustic piano tones in the acoustic sound mode, and prohibits the acoustic piano 100 from generating the acoustic piano tones in the silent mode. When the solo mode is established in the hybrid keyboard musical instrument, one of the acoustic sound mode and the silent mode is established in the acoustic piano 100. However, when the hybrid keyboard musical instrument is changed to the ensemble mode, the acoustic sound mode is established in the acoustic piano for performing an ensemble together with the electric sound generating system 104, or the electric sound generating system 104 gets ready for an ensemble, because the electric sound generating system 104 has more than one tone generator as will be hereinlater described in detail. When the hybrid keyboard musical instrument is changed to the concurrent mode, both of the acoustic piano and the electric sound generating system 104 get ready for the concurrent tone generation, or only the electric sound generating system gets ready for the concurrent tone generation.

A user communicates with the controlling system 107 through the user interface 105. The controlling system 107 supplies prompt messages or status messages through the user interface 105 to the user, and the user gives instructions through the user interface 105 to the controlling system 107. The data sources 106 supply the controlling system 107 pieces of music data information alone or together with pieces of video data information, and the controlling system 107 transfers the pieces of music data information to the electric sound generating system 104 and/or the automatic playing system 101 depending upon the instruction given through the user interface 105. The pieces of video data information are supplied from the controlling system 107 to the user interface 105. These component systems are hereinbelow described in detail.

The acoustic piano 100 further comprises action mechanisms 114, hammers 115, damper mechanisms 116 and music strings 117. These component parts 111 to 116 are linked with one another, and generate the acoustic piano tones. The black keys 112 and white keys 113 are laid on the well-known pattern, and form in combination the keyboard 111. The notes of the scale are respectively assigned to the black/white keys 112/113. The keyboard 111 is mounted on a key bed 118. The black/white keys 101*f*/101*g* are turnable around a balance rail 119, and are held in contact with the associated action mechanisms 114 by means of capstan screws 120.

The action mechanisms 114 are rotatable around a center rail 121. Each of the action mechanisms 114 includes a jack 122 and a regulating button 123. When the jack 122 is brought into contact with the regulating button 123, the jack 122 escapes from the associated hammer 115, and the hammer 115 is driven for rotation around a shank flange rail 124.

The hammers 115 have rest positions under the associated music string 117, respectively, and strike the music strings 117 for generating the acoustic piano tones. Upon striking the associated music strings 117, the hammers 115 rebound, and return toward the rest positions. The rebounding hammer 115 is gently received by a back check 125 on the way to the rest position, and the back check 125 guides the hammer 115 to the rest position after the depressed key 112/113 is released.

The damper mechanisms 116 have respective damper heads 126, and are actuated by the black/white keys 112/113, respectively. The damper heads 126 are held in contact with the associated music strings 117, and prevent the music strings 117 from resonance with a vibrating music string 117.

A pianist is assumed to depress a black/white key 112/113. The black/white key 112/113 is sinking toward the end position, and pushing the associated damper mechanism 116 upwardly. The damper head 126 is spaced from the associated music string 117, and the music string 117 is allowed to vibrate. Thereafter, the actuated action mechanism 114 gives rise to the rotation of the hammer 115, and the hammer 115 strikes the music string 117 for generating, the acoustic piano tone. Thus, the component parts 111 to 116 are sequentially actuated for generating the acoustic piano tones as similar to the standard grand piano.

The silent system 103 includes a hammer stopper 130 and an electric motor 131. The hammer stopper 130 laterally extends in the space between the music strings 117 and the array of hammers 115, and is bi-directionally rotated by means of the electric motor 131. The hammer stopper 130 has a resilient sheet 132, and is changed between a free position FP and a blocking, position BP. The hammer stopper 130 is out of the trajectories of the hammers 115 in the free position FP, and the hammers 115 strike the associated music strings 117 without any interruption of the hammer stopper 130. When the resilient sheet 132 is directed to the hammers 115, the hammer stopper 130 enters the blocking, position, and the resilient sheet 132 is on the trajectories of the hammers 115. When the jack 122 escapes from the associated hammer 115, the hammer is driven for rotation toward the associated music string 117. However, the hammer 115 rebounds on the resilient sheet 132 before striking, the music string 117, and the music string 117 does not vibrate. Thus, the hammer stopper 130 in the free position FP establishes the acoustic sound mode in the acoustic piano 100. When the hammer stopper 130 is changed to the blocking position BP, the acoustic piano 100 enters the silent mode. The controlling system 107 instructs the electric motor 131 to change the hammer stopper 130 between the blocking, position BP and the free position FP depending upon the mode of operation selected by a user.

The automatic playing system 101 comprises an array of solenoid-operated key actuators 141 and a servo-controller 142. The array of solenoid-operated key actuators 141 is supported by the key bed 118, and the solenoid-operated key actuators 141 are exposed to the space under the rear portions of the black/white keys 112/113. The solenoid-operated key actuators 141 are arranged in a staggered manner, and projects the plungers to and retract the plunger from the associated black/white keys 112/113. Though not shown in FIG. 1, plunger position sensors are incorporated in the solenoid-operated key actuators 141, respectively, and supply plunger position signals representative of current plunger position to the servo-controller 142. The controlling system 107 determines the black/white keys 112/113 to be moved on the basis of a set of MIDI (Musical Instrument Digital Interface) music data codes, and instructs the servo-controller 142 to move the plunger of each solenoid-operated key actuator 141 at a target velocity Vr on a plunger trajectory. The servo-controller 142 determines the magnitude of a driving pulse signal for the target velocity Vr, and supplies the driving pulse signal to the solenoid-operated key actuator 141 associated with the black/white key 112/113 to be moved. The solenoid-operated key actuator 141 projects the plunger, and the plunger sensor reports the current plunger position to the servo-controller 142. The servo-controller 142 calculates the actual plunger velocity, and compares the actual plunger velocity with the target velocity Vr to see whether or not the solenoid-operated key actuator 141 appropriately moves the associated black/white key 112/113. If the actual plunger velocity is different from the target velocity Vr, the servo-controller 142 changes the magnitude of the driving pulse signal so as to impart the target velocity Vr to the black/white key 112/113. When the solenoid-operated key actuator 141 pushes up the rear portion of the associated black/white key 112/113, the black/white key 112/113 actuates the associated action mechanism 114 and the damper mechanism 116, and causes the hammer 115 to strike the music string 117.

The controlling system 107 gives the instructions to the servo-controller 142 in the predetermined order, and the black/white keys 112/113 are sequentially moved without fingering on the keyboard 111. Thus, the automatic playing system 101 plays a tune or a piece of music passage on the acoustic piano 100 in the acoustic sound mode and the concurrent mode.

Figure 2:
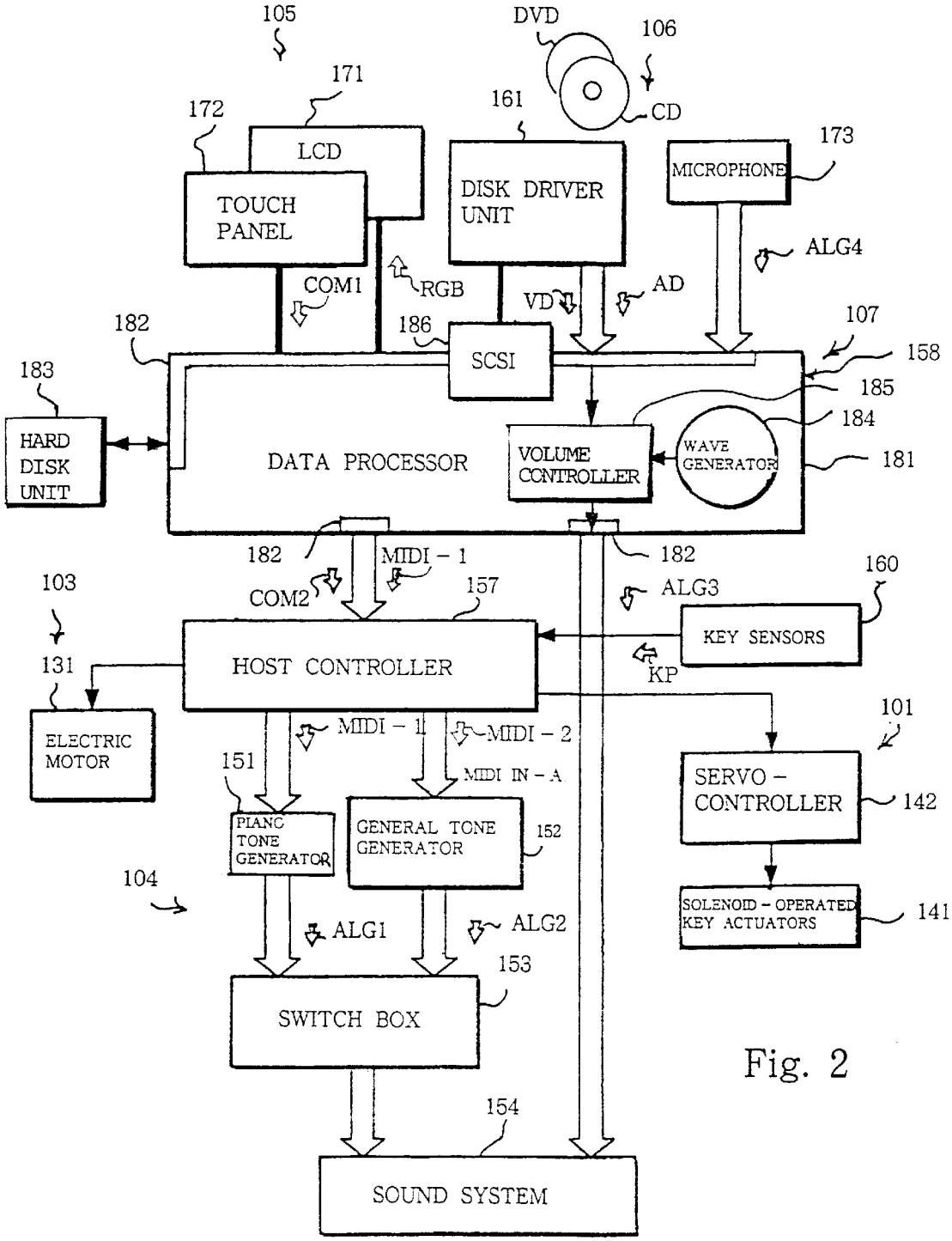
FIG. 2 is a block diagram showing electric components incorporated in the hybrid keyboard musical instrument.
Figure 5:
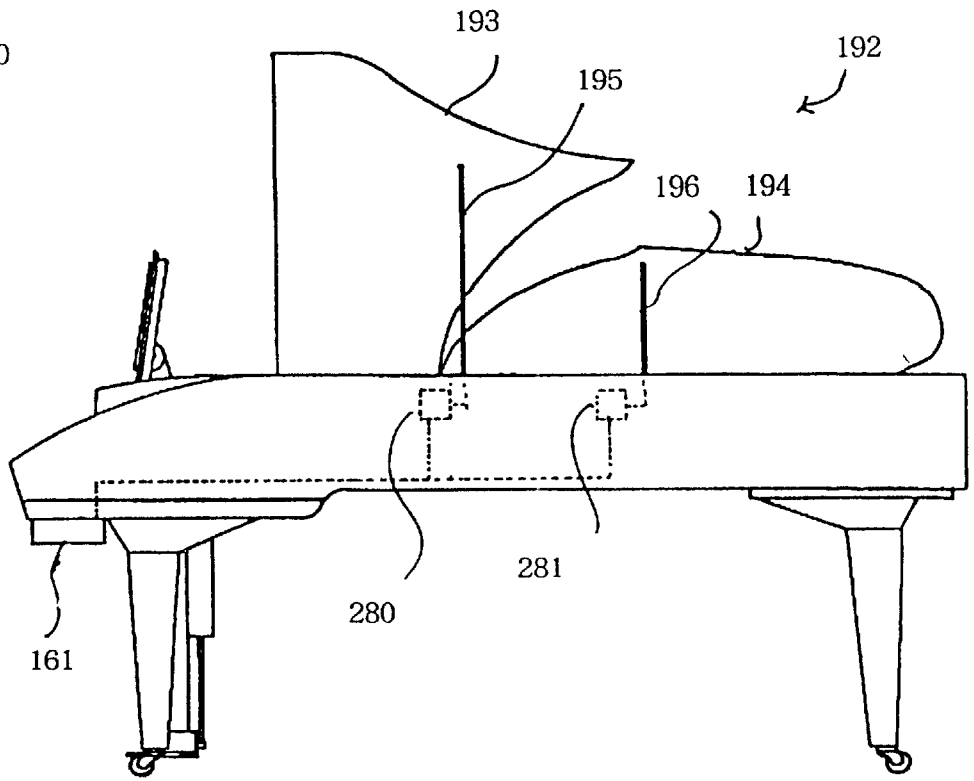
FIG. 5 is a side view showing the hybrid keyboard musical instrument.
Figure 4:
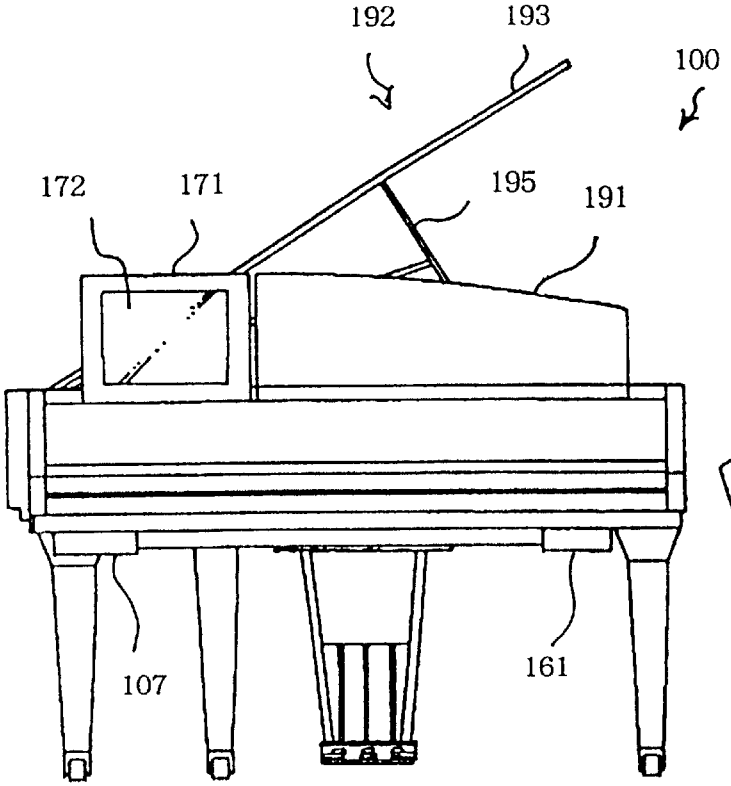
FIG. 4 is a front view showing the hybrid keyboard musical instrument.

The electric sound generating system 104, the user interface 105, the data sources 106 and the controlling system 107 are hereinbelow described in detail with reference to FIG. 2.

The electric sound generating system 104 includes a piano tone generator 151, a general tone generator 152, a switch box 153 and a sound system 154. Parameters for the acoustic piano tones are stored in the piano tone generator 151, and the piano tone generator 151 produces an analog audio signal ALG1 from the MIDI music data codes MIDI-1. The general tone generator 152 produces an analog audio signal ALG2 from the MIDI music data codes MIDI-2, and imparts selected timbre to the electronic tones produced from the analog audio signal ALG2. The selected timbre may be like the piano tones. When the user selects a timbre through the user interface 105, the controlling system 107 supplies parameters to be required for the selected timbre to the general tone generator 152, and sets the general tone generator 152 by the parameters.

The controlling system 107 selectively supplies the MIDI music data codes MIDI-1/MIDI-2 to the piano tone generator 151 and the general tone generator 152, and the piano tone generator 151 and the general tone generator 152 produces the analog audio signals ALG1/ALG2 from the MIDI music data codes MIDI-1/MIDI-2. The switch box 153 selectively connects the piano tone generator 151 and the general tone generator 152 to the sound system 154. The sound system 154 includes an amplifier, speakers and a headphone, and generates the electronic tones from the analog audio signals ALG1/ALG2. Although the general tone generator 152 can produce the analog audio signal ALG2 representative of piano tones, the piano tones produced from the analog audio signal ALG1 is higher in quality than the piano tones produced from the analog audio signal ALG2. The controlling system 107 directly supplies an analog audio signal ALG3 to the sound system 154, and the sound system 154 generates electronic tones from the analog audio signal ALG3. Thus, the electronic sound generating system 104 can perform a tune or a piece of passage.

An array of key sensors 160 and a disk driver unit 161 serve as data sources 106, and the controlling system 107 includes a host controller 157 and a data processing system 158. A liquid crystal display panel 171, a touch panel 172 and a microphone 173 form in combination the user interface 105. The liquid crystal display panel 171 is abbreviated as "LCD" in FIG. 2. The host controller 157 and the data processing system 158 receive various data signals from the data sources 106, and process the pieces of data information as follows.

The array of key sensors 160 is mounted on the key bed 118 under the keyboard 111, and the key sensors 160 are respectively associated with the black/white keys 112/113. The key sensors 160 monitor the black/white keys 112/113 so as to produce key position signals KP representative of the current key positions of the associated black/white keys 112/113. The key position signals KP are supplied to the host controller 157. The host controller 157 discriminates a depressed/released key 112/113 from the difference between the previous key position and the current key position and calculates the velocity of the depressed/released key 112/113. The host controller 157 stores the note number assigned the depressed/released key 112/113. The key velocity and the time for initiating the key motion in MIDI music data codes, and supplies the MIDI music data codes to the piano tone generator 151 or the general tone generator 152 for generating the electronic tones. Thus, the hybrid keyboard musical instrument generates the electronic tones in response to the fingering on the keyboard 111 along a tune or a piece of passage.

The disk driver unit 161 is connected to the data processing system 158. A suitable information storage medium such as, for example, a CD-ROM (Compact Disk Read Only Memory) disk CD and a DVD-ROM (Digital Versatile Disk Read Only Memory) disk DVD is insertable into the disc driver unit 161. Sets of MIDI music data codes, sets of audio data codes and sets of video data codes are stored in the information storage medium. The disk driver unit 161 reads out a set of MIDI/audio/video data codes from the information storage medium, and supplies the audio data codes AD and the video data codes VD to the data processing system 158. MIDI music data codes may be produced from the audio data codes, and are available for a performance by the automatic player system 101 and reproduction of a tune through the electronic sound generating system 104.

The data processing system 158 produces an analog video signal RGB from the video data codes, and supplies the analog video signal RGB to the liquid crystal display panel 171. A set of video data codes represents a menu and messages to user, and another set of video data codes represents a moving picture. With the analog video signal RGB, the menus, the prompt/status messages and/or the pictures are produced on the liquid crystal display panel 171. The menus are produced in the static pictures. Yet another set of audio data codes is used for producing a music score on the liquid crystal display panel, and a user plays a tune on the keyboard in accordance with the music score.

The data processing system 158 produces a menu on the liquid crystal display panel 171, and prompts the user to input instructions through prompt messages concurrently produced on the liquid crystal display panel 171. The touch panel 172 is overlapped with the liquid crystal display panel 171, and the user gives instructions to the data processing system 158 through the touch panel 172. Namely, when the user touches an item on the menu, the touch panel 172 produces a command signal COM1 corresponding, to the selected item, and supplies the command signal COM1 to the data processing system 158. The command signal COM1 is, by way of example, representative of the mode of operation to be established in the hybrid keyboard musical instrument, a selected sound source, i.e., the acoustic piano and/or the electric sound generating system 104, the player on the keyboard 111, i.e., the user or the automatic playing system 101 etc. The data processing system 158 informs the user of the current status of the hybrid keyboard musical instrument. Another menu is produced on the liquid crystal display panel 171, and the user gives various parameters and instructions to the general tone generator 152 and the piano tone generator 151 through the touch panel 172.

Another set of video data codes is representative of a static picture or a moving picture. While the acoustic piano and/or the electric sound generating system 104 is playing a tune or a piece of passage, the data processing system 158 can supply the analog video signal RGB to the liquid crystal display 171 for producing an appropriate picture. While the data processing system 158 is producing the static/moving picture on the liquid crystal display panel 171, appropriate sound or a piece of music may be produced from the electronic sound generating system 104 in synchronism with the static/moving picture.

The data processing system 158 can recognize voice messages. The microphone 173 picks up voice of a user, and supplies an analog voice signal ALG4 to the data processing system 158. The data processing system 158 analyzes a voice message on the analog voice signal ALG4, and recognizes user's instructions. Thus, the user can give instructions through the microphone 173 to the data processing system 158.

A data processor 181, a data interface 182, a hard disk unit 183, a wave generator 184 and a volume controller 185 are incorporated in the data processing system 158. The data interface 182 includes a SCSI (Small Computer System Interface) port 186, and the disk driver unit 161 is connectable through the SCSI port 186 to the data processor 181 as shown. The liquid crystal display panel 171, the touch panel 172, the microphone 173, the hard disk unit 183, the host controller 157 and the sound system 154 are connectable through the data interface ports to the data processor 181.

Application programs are stored in the hard disk unit 183, and the data processor 181 reads out the application programs from the hard disk unit 183. When the data processing system 158 is powered, the data processor 181 initializes the components of the system 107, internal registers and internal buffers, and reiterates a main routine program. The main routine program has a step for producing the prompt/status messages on the liquid crystal display panel and another step at which the data processor 181 checks the data interface 182 to see whether or not the user gives instructions through the touch panel 172 and/or the microphone 173. When the data processor recognizes the given instructions, the main routine program branches into an appropriate subroutine program.

A control sequence for the hybrid keyboard musical instrument is further stored in the hard disk unit 183. FIG. 3 illustrates an example of the control sequence. A user can program the control sequence, and the data processing system 158 changes the hybrid keyboard musical instrument between the solos, the ensemble and the concurrent tone generation without complicated manipulation on the touch panel 172 as will be described hereinlater in detail.

When the user instructs the data processing system 158 to reproduce a tune from the audio data codes AD at certain loudness, the data processor 181 instructs the volume controller 185 to adjust the loudness to the given level, and requests the disk driver unit 161 to transfer a series of audio data codes AD from the CD-ROM disk CD through the SCSI port 186. The disk driver unit 161 sequentially supplies the audio data codes AD representative of the selected tune through the data interface 182 to the data processor 181, and the data processor 181 produces the analog data signal ALG3 from the audio data codes AD. The analog audio signal ALG3 is supplied to the volume controller 185, and is regulated to the given level. The analog audio signal ALG3 is supplied through the data interface 182 to the sound system 154, and the tune is reproduced through the sound system 154.

The wave generator 184 is a kind of sound source, and generates an analog wave signal from audio data codes stored in a sound card (not shown). The sound card is incorporated in the data processor 181. The data codes are representative of percussion sound, a piece of orchestral music and human voice. A user may instruct the data processor 181 to produce percussion sound through the wave generator 184. The user can instructs the data processor 181 to mix the analog wave signal to the analog audio signal ALG4 and to change the loudness to the wave sound. The analog wave signal is transferred through the volume controller 185 to the sound system 154 without the mixing.

The host controller 157 is connected to the electric motor 131, the piano tone generator 151 the general tone generator 152, the key sensors 160 and the servo-controller 142. The data processing system 158 supplies a command signal COM2 representative of instructions of the data processor 181 and the MIDI music data codes MIDI-1 to the host controller 157. As described hereinbefore, the host controller 157 changes the hammer stopper 130 between the blocking position BP and the free position FP for changing the acoustic piano 100 between the acoustic sound mode and the silent mode. The host controller 157 further produces the MIDI music data codes MIDI-1/MIDI-2 on the basis of the key position signals KP, and supplies the MIDI music data codes to the piano tone generator 151 or the general tone generator 152 for producing the electronic tones. Thus, the host controller 157 cooperates with the other systems 101/103/104/106 under the control of the data processing system 158 in all the modes, i.e., solo, ensemble and concurrent modes.

Although the liquid crystal display panel 171 is provided on the acoustic piano 100 beside a music rack 191, the controlling system 107 and the disk driver unit 161 are attached to the lower surface of the key bed 118 on both sides of a pianist sitting in front of the keyboard 111. For this reason, the hybrid keyboard musical instrument has the external appearance quite similar to that of a standard grand piano. The liquid crystal display panel is three-dimensionally movable. The pianist can direct the liquid crystal display panel 171 to an arbitrary direction, and gives instructions through the touch panel 172 without standing up.

The hybrid keyboard musical instrument has a split top board 192. The split top board 192 is split into a front board 193 and a rear board 194, and the front board 193 and the rear board 194 are hinged to a side board. The front board 193 and the rear board 194 are independently changed between open state and closed state, and lid props 195 and 196 keep the front board 193 and the rear board 194 in the open state as shown. The pianist selectively opens and closes the front/rear boards 193/194 so as to selectively emphasize the lower-pitched part or the higher-pitched. When only the front board 193 is opened, the higher-pitched part is emphasized. On the other hand, if the pianist keeps the front board 193 and the rear board 194 open and close, respectively, the lower-pitched part is emphasized. Component parts 281/281 will be described hereinlater.

Behavior in Modes of Operation

As described hereinbefore, the data processor 181 fetches the video data codes from the SCSI port 186, and produces a static picture on the liquid crystal panel 171. As described hereinbefore, the menus are given through static pictures. The static pictures are shown in FIGS. 6, 7, 8 and 9, and are referred to as "disklavier plane", "performance plane", "CD-ROM plane" and "audio CD player plane", respectively. These planes include menus and switches, and a user gives the instructions through the touch panel 172 overlapped with the menus and switches. The behavior of the hybrid keyboard musical instrument is described with reference to those planes.

Disklavier Plane

Figure 6:
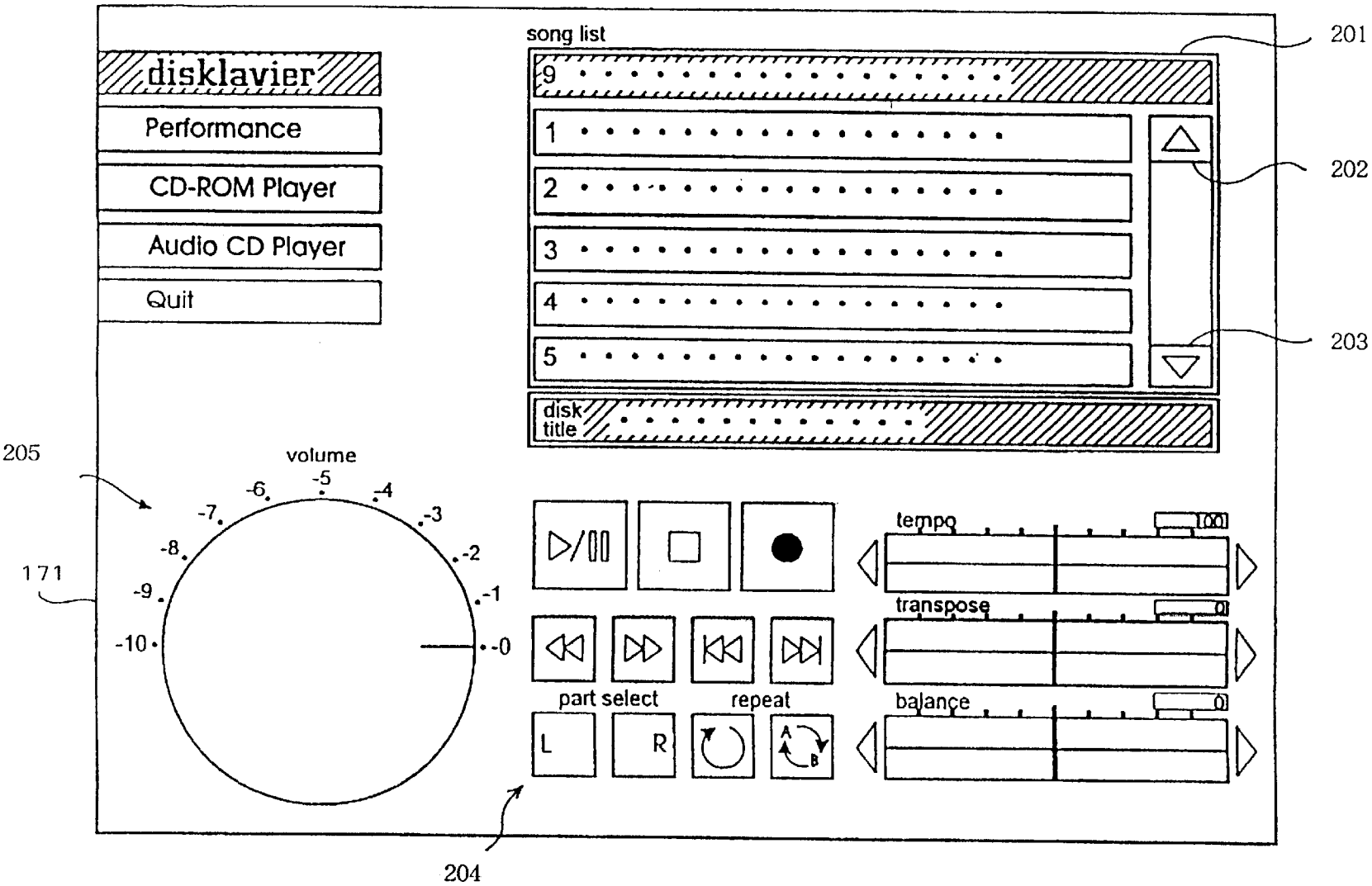
FIG. 6 is a view showing a disklavier plane produced on a liquid crystal display panel.

FIG. 6 shows the disklavier plane. The disklavier plane is used for the automatic playing system 101. When a user requests the automatic playing system 101 to perform a tune or an ensemble with the data processing system 158, the data processing system 158 produces a menu shown in figure on the liquid crystal display panel 171. The electric sound generating system 104 performs an ensemble together with the automatic playing system 101. The name of the plane "disklavier" is shown in the upper portion on the left side.

A song list 201 is produced in the upper portion of the right side together with the disk title where the songs are stored. Although only five songs are presently shown, the user can roll up or down the song list by using direction indicators 202/203. Titles of pieces of instrument music may be incorporated in the "song list". A volume dial 205 is produced in the lower portion of the left side. The user turns the volume dial 205 to regulate the loudness of the acoustic piano tones.

Three indicators "tempo", "transpose" and "balance" are produced in the lower portion of the right side. The indicator "tempo" is indicative of the speed at which the automatic playing system is to perform a tune. The indicator "transpose" is indicative of the interval between an original tune and a tune after transposition, and the indicator "balance" is indicative of the volume balance between the acoustic piano tones and the electronic tones. In the ensemble with the data processing system 158, the host controller 157 may supply the MIDI music data codes MIDI-2 in a certain track to the general tone generator 152, and sound system 154 generates the electronic tones 154 from the analog audio signal ALG2. The wave generator 184 may participate the ensemble. An image of needle is movable on the touch panel 172. The user moves the needle to change the tempo, the key and the balance. If the user does not change the indicators "tempo", "transpose" and "balance", the song is performed at the default values.

An array of switches 204 is produced in the lower portion of the central area, and a start button, a stop button, a rewind button, a quick button, part select buttons and repeat mode select switches are incorporated in the array of switches 204. The user selectively pushes the buttons through the touch panel 172 so as to give instructions to the data processing system 158.

After selection of a song and regulation of volume, the user pushes the start button. Then, the disk river unit 161 reads out a set of audio data codes representative of the selected song from the compact disk CD, and transfers the audio data codes to the SCSI port 186. The data processor 181 produces MIDI music data codes, and transfers the MIDI music data codes MIDI-1 to the host controller 157. The host controller 157 sequentially determines key-on events and key-of events, and determines the target key velocity for each depressed/released keys 112/113. The target key velocity is supplied to the servo-controller 142, and serve-controller 142 determines the magnitude of the key driving signals. The servo-controller 142 selectively raises the key driving signals at the key-on events and decays the key driving signals at the key-off events, and controls the solenoid-operated key actuators 141 through the feedback loops. The solenoid-operated key actuators 141 sequentially move the black/white keys 112/113 without lingering on the keyboard 111, and performs the tune for the selected song.

When the user touches the switch "Quit", the electric power is removedfrom the electric/electronic systems of the hybrid keyboard musical instrument.

Performance Plane

Figure 7:
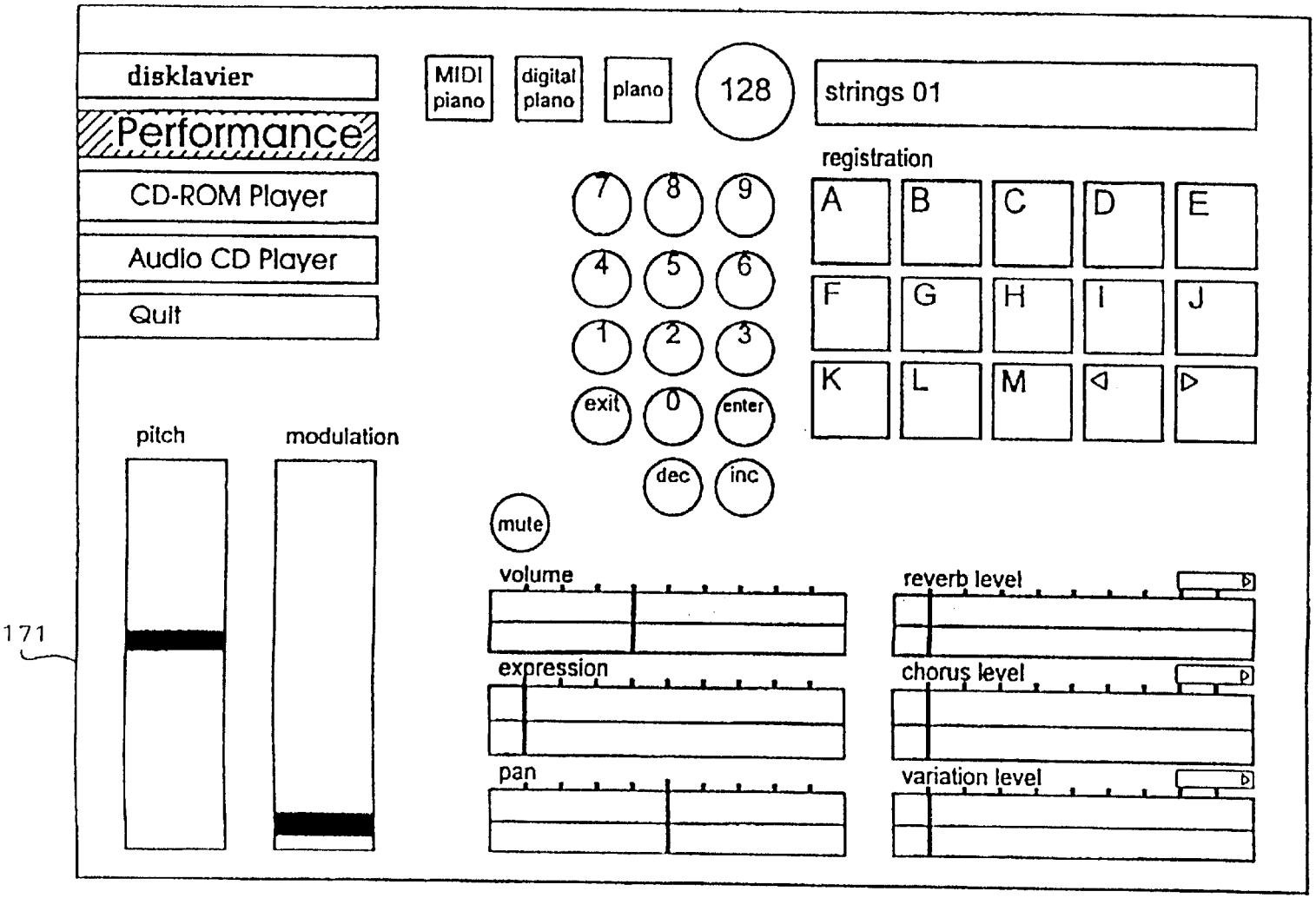
FIG. 7 is a view showing a performance plane produced on the liquid crystal display panel.

When the user touches the switch "performance", the data processing system 158 produces the performance plane on the liquid crystal display panel 171 shown in FIG. 7. The performance plane is used for performance on the keyboard 111 by a pianist. The name of the plane is shown in the upper portion on the left side. A user carries out a selection for a source of tones, a registration of parameters for the tone generators 151/152 and a registration of the control sequence through the performance panel.

Three switches "piano", "digital piano" and "MIDI piano" are produced in the upper portion of the center area, and a switch "mute" is produced in the central area. The switches "piano", "digital piano", "MIDI piano" and "mute" are used for the selection of tone source. The user selects a source of tones as follows. When the user touches the switch "piano", the host controller 157 supplies the driving current to the electric motor 131, and the electric motor 131 changes the hammer stopper 130 to the free position FP. The acoustic piano 100 is ready for generating the acoustic piano tones. The user plays a tune through the acoustic piano tones on the acoustic piano 100. If the tone generator 152 is requested to concurrently generate electronic tones for an ensemble, the host controller 157 supplies the MIDI music data codes MIDI-2 already read into the internal memory to the general tone generator 152 for producing the analog audio signal ALG2, and the sound system 154 generates the electronic tones from the analog audio signal ALG2. Using the switch "piano", a pianist may play a concerto together with the general tone generator 152. The timbre of the electronic tones is indicated by a circular area and a display window on the right side of the switch "piano". In the "performance plane" shown in FIG. 7, the selected timbre is assigned a timbre number "128", and is referred to as "strings01".

If the user touches the switch "digital piano", the host controller 157 instructs the electric motor 131 to change the hammer stopper 130 to the blocking position BP, and the user plays a tune through the electronic tones on the keyboard 111. While the user selectively depresses and releases the black/white keys 112/113, the key sensors 160 notifies the key motions to the host controller 157, the host controller 157 supplies the MIDI music data codes MIDI-1 to the piano tone generator 151, and the sound system 154 such as, for example, the headphone generates the electronic tones from the analog audio signal ALG1. If the general tone generator 152 is requested to concurrently generate electronic tones for an ensemble, the host controller 157 further supplies the MIDI music data codes MIDI-2 already read into the internal memory to the general tone generator 152 for producing the analog audio signal ALG2, and the sound system 154 generates the electronic tones from the analog audio signal ALG2 or the ensemble. Using, the switch "digital piano" a pianist may play a piano duo. The circular area and the display window indicate the selected timbre of the electronic tones generated from the analog audio signal ALG2.

If the user touches the switch "MIDI piano", the host controller 157 instructs the electric motor 131 to change the hammer stopper 130 to the blocking, position BP, and deactivates the piano tone generators 151 and 152. While the user is playing a tune on the keyboard 111, the key sensors 160 notifies the key motions to the host controller 157, the host controller 157 generates the MIDI music data codes MIDI-2, and supplies the MIDI music data codes MIDI-2 through the MIDI interface port to a MIDI cable. The MIDI cable may be connected to another musical instrument. The timbre is similarly indicated through the circular area and the display window.

The switch "mute" is used together with one of the switch "piano", by way of example. When the user touches the switch "mute", the host controller 157 deactivates the general tone generator 152, and the user plays a tune only through the acoustic piano tones. Thus, the user selects a source of tone or sources of tones through the four switches "piano", "digital piano", the MIDI "piano" and "mute".

Ten keys "0" to "9" and instruction keys "exit", "enter", "dec" and "inc" are produced in the central area, and eight indicators "volume", "expression", "pan", "reverb level", "chorus level", "variation level", "pitch" and "modulation" are produced the lower portion. The ten keys are used for selecting the timbre of electronic tones, and the indicators are indicative or the parameters given to the tone generator 152 for generating, the electronic tones.

The user manipulates the ten keys and the instruction keys for selecting the timbre of electronic tones. The circular area is indicative of the timbre number assigned to the selected timbre, and the timbre name is shown in the display window.

When the user changes a parameter of the electronic tones, the user touches the associated indicator, and moves the needle in the selected indicator. The indicator "volume" is assigned to the loudness of the electronic tones. The indicator "expression" is assigned to variation in the loudness such as, for example, fade-out. The indicator "pan" is assigned to balance of stereophonic tones between the right side and the left side. The depth of reverb is indicated by the indicator "reverb level". The magnitude of chorus effect, i.e., the spread of tones is indicated by the indicator "chorus level". The indicator "variation level" is indicative of a destination and an over-drive. The modulation effect is indicated by the indicator "modulation", and the pitch of the electronic tones is indicated by the indicator "pitch".

The indicators "reverb level", "chorus level" and "variation level" are accompanied with small switches, respectively. It the user touches the small switch, the data processing system 158 produces another static picture for details of the associated parameter.

The needle of the indicator "volume" is colored differently from the needles of the other indicators so that the user clearly discriminates the loudness of electronic tones. Similarly, the indicators "pitch" and "modulation" have thick needles, and the thick needles inform the user of relative levels in the ranges.

Registration buttons "A" to "M" are produced in the lower portion of the right side. The registration buttons "A" to "M" are used for registration of the user's selection shown in the current performance panel. When the user continuously touches one of the registration buttons such as "A" for a predetermined time period, the source of tone and the parameters shown in the current performance panel are stored in a storage area of the hard disk unit 183 assigned to the registration button "A".

The user is assumed to have touched only the switch "piano" on the performance panel. When the user continuously touches the registration button "A", the data processor 181 writes the present status of the hybrid keyboard musical instrument into the storage area as shown in row "A" of FIG. 3. The hammer stopper 130 is to be in the free position FP, and the piano tone generator 151 is to be deactivated. The general tone generator 152 is to generate the analog audio signal ALG2 for the electronic tones under the parameters. The timbre number is 128. The current values of the parameters are transferred from the data processor 181 to the hard disk unit 183, and are stored in the sub-areas "volume", "expression", "pan", . . .

The user is assumed to have touched the switch "digital piano". When the user continuously touched the registration button "B", the data processor 181 writes the present status of the hybrid keyboard musical instrument into the storage area as shown in row "B" of FIG 3. The hammer stopper 130 is to be in the blocking position BP, and the piano tone generator 151 is to be activated. The general tone generator 152 is to generate the analog audio signal ALG2 for the electronic tones under the selected parameters. The timbre number is also 128. The current values of the parameters are transferred from the data processor 181 to the hard disk unit 183, and are stored the data storage area assigned to row "B"

The user is assumed to have touched the switch "MIDI piano". When the user continuously touched the registration button "C", the data processor 181 writes the present status of the hybrid keyboard musical instrument into the storage area as shown in row "C". The hammer stopper 130 is to be in the blocking position BP, and the piano tone generator 151 is to be deactivated. The general tone generator 152 is to generate the analog audio signal ALG2 for the electronic tones under the selected parameters. The timbre number is also 128. The current values of the parameters are transferred from the data processor 181 to the hard disk unit 183, and are stored the data storage area assigned to row "C".

Thus, the user registers pieces of status information each representative of the current status of the hybrid keyboard musical instrument in the hard disk driver 183 by using the registration buttons. The user can call the piece of status information. The user is assumed to touch one of the registration buttons such as "A" for a time period shorter than the predetermined time period. The data processor 181 fetches the piece of status information from the storage area assigned to the row "A", and instructs the host controller 157 to establish the status in the hybrid keyboard musical instrument. Thus, the performance panel is available for the quick establishment of the status into the hybrid keyboard musical instrument.

After the registration of the pieces of status information, the user is assumed to start a performance on the hybrid keyboard musical instrument. When the user shortly touches the registration button "A", the data processor 181 fetches the piece of status information from the storage area assigned to row "A", and supplies the command signal COM2 to the host controller 157. Then, the host controller 157 instructs the electric motor 131 to change the hammer stopper 130 to the free position FP, deactivates the piano tone generator 151, and supplies the parameters to the general tone generator 152. Thus, the status represented by the switch "piano" is quickly established in the hybrid keyboard musical instrument. While the user is fingering on the keyboard, the hammers 115 sequentially strike the associated music strings 117, and the sound system 154 generates the electronic tones.

If the user shortly touches the registration button "B", the data processor 181 fetches the piece of status information from the storage area assigned to row "B", and supplies the command signal COM2 to the host controller 157. Then, the host controller 157 instructs the electric motor 131 to change the hammer stopper 130 to the blocking position BP, activates the piano tone generator 151, and supplies the parameters to the general tone generator 152. Thus, the status represented by the switch "digital piano" is quickly established in the hybrid keyboard musical instrument. While the user is fingering on the keyboard, the key sensors 160 notifies the key motions to the host controller 157, the host controller 157 supplies the MIDI music data codes MIDI-1 and MIDI-2 to the piano tone generator 151 and the general tone generator 152, and the sound system 154 such as, for example, the headphone and the speaker system generate two kinds of electronic tones, respectively.

If the user shortly touches the registration button "C", the data processor 181 fetches the piece of status information from the storage area assigned to row "C", and supplies the command signal COM2 to the host controller 157. Then, the host controller 157 instructs the electric motor 131 to change the hammer stopper 130 to the blocking position BP, deactivates the piano tone generator 151, and supplies the parameters to the general tone generator 152. Thus, the status represented by the switch "MIDI piano" is quickly established in the hybrid keyboard musical instrument. While the user is fingering on the keyboard 111, the key sensors 160 notifies the key motions to the host controller 157, the host controller 157 supplies the MIDI music data codes MIDI-2 to the general tone generator 152, and the sound system 154 such as, for example, the generate the electronic tones.

CD-ROM Plane

Figure 8:
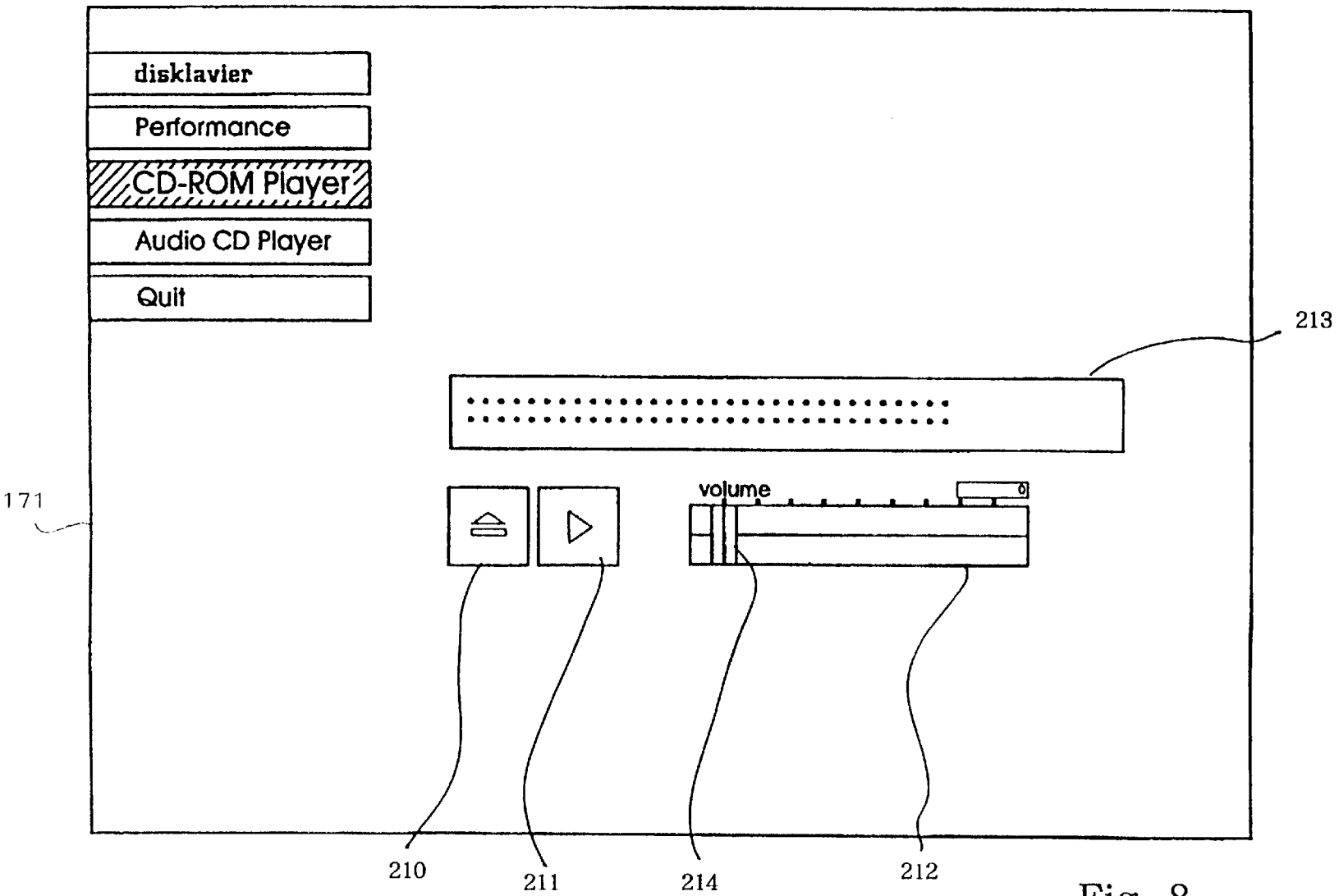
FIG. 8 is a view showing a CD-ROM plane produced on the liquid crystal display panel.

When a user wants to reproduce a tune stored in the CD-ROM disk CD, the user touches the area "CD-ROM Player" in the upper portion of the left side, and the CD-ROM plane is produced on the liquid crystal display panel 171 (see FIG. 8). The name of the plate "CD-ROM Player" is emphasized. An inject button 10, a play button 211 and a volume indicator 212 are produced on the liquid crystal display panel 171 together with a display window 213. The inject button 210 is used for open and close a disk tray, and the user instructs the playback to the data processing system 158 through the start button. The user touches the bar 214, and moves it rightward or leftward for changing the loudness of the tones. A title of the compact disk CD is indicated in the display window 213. If a music score is stored in the compact disk CD, the staff notation is successively produced in the display window 213. Therefore, the user can play the tune along the music score produced in the display window 213.

When the user touches the start button 211, the disk driver unit 161 reads out a set of audio data codes or a set of MIDI music data codes from the compact disk CD, and transfers the set of data codes to the data processor 181. The data processor 181 produces the analog audio signal ALG3 from the audio data codes, or instructs the host controller 157 to cause the general tone generator 152 to produce the analog audio signal ALG2. The analog audio signal ALG2/ALG3 is supplied to the sound system 154, and the electronic tones are radiated from the sound system 154.

Audio CD Player Plane

Figure 9:
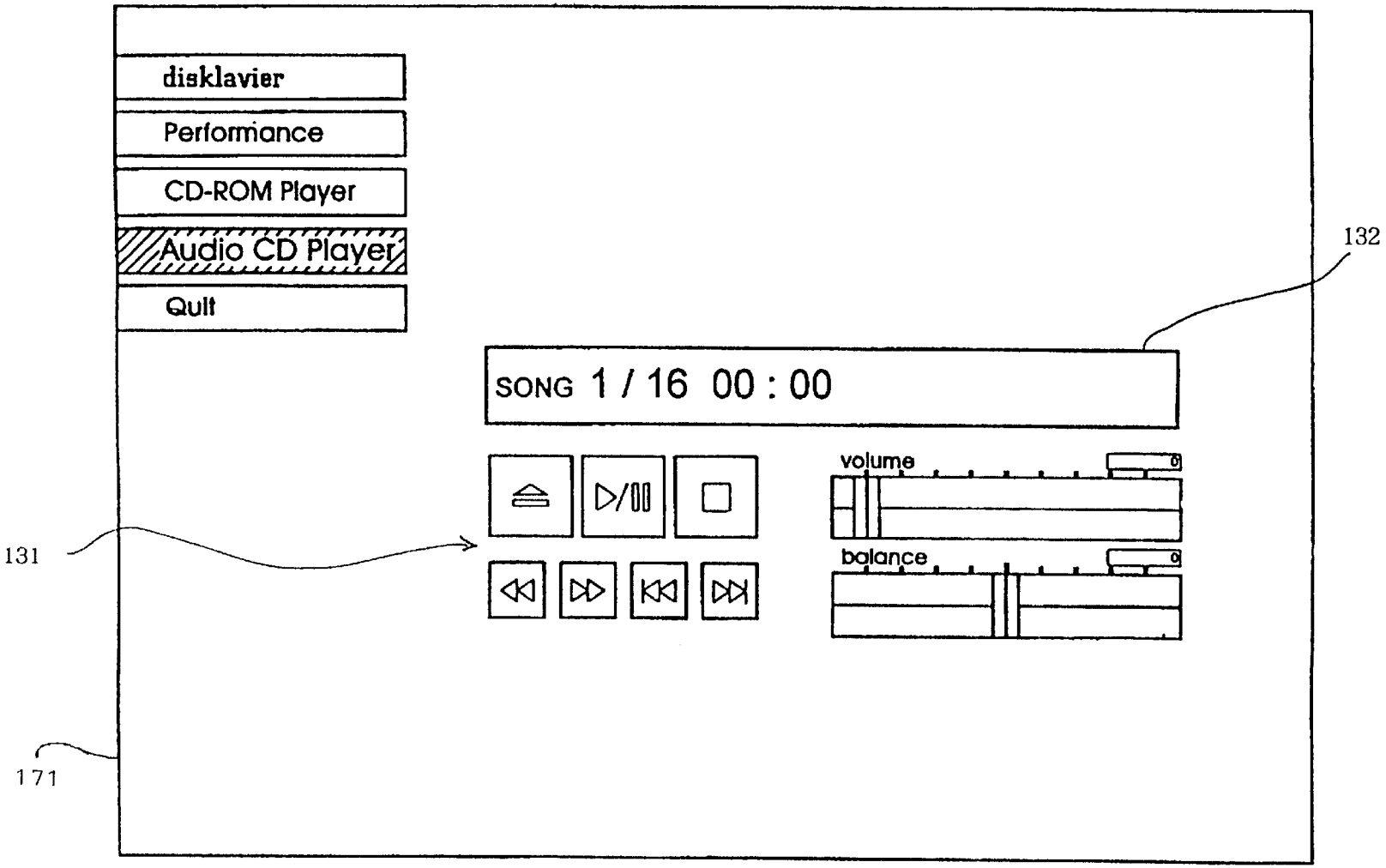
FIG. 9 is a view showing an audio CD player plane produced on the liquid crystal display panel.
Figure 10:
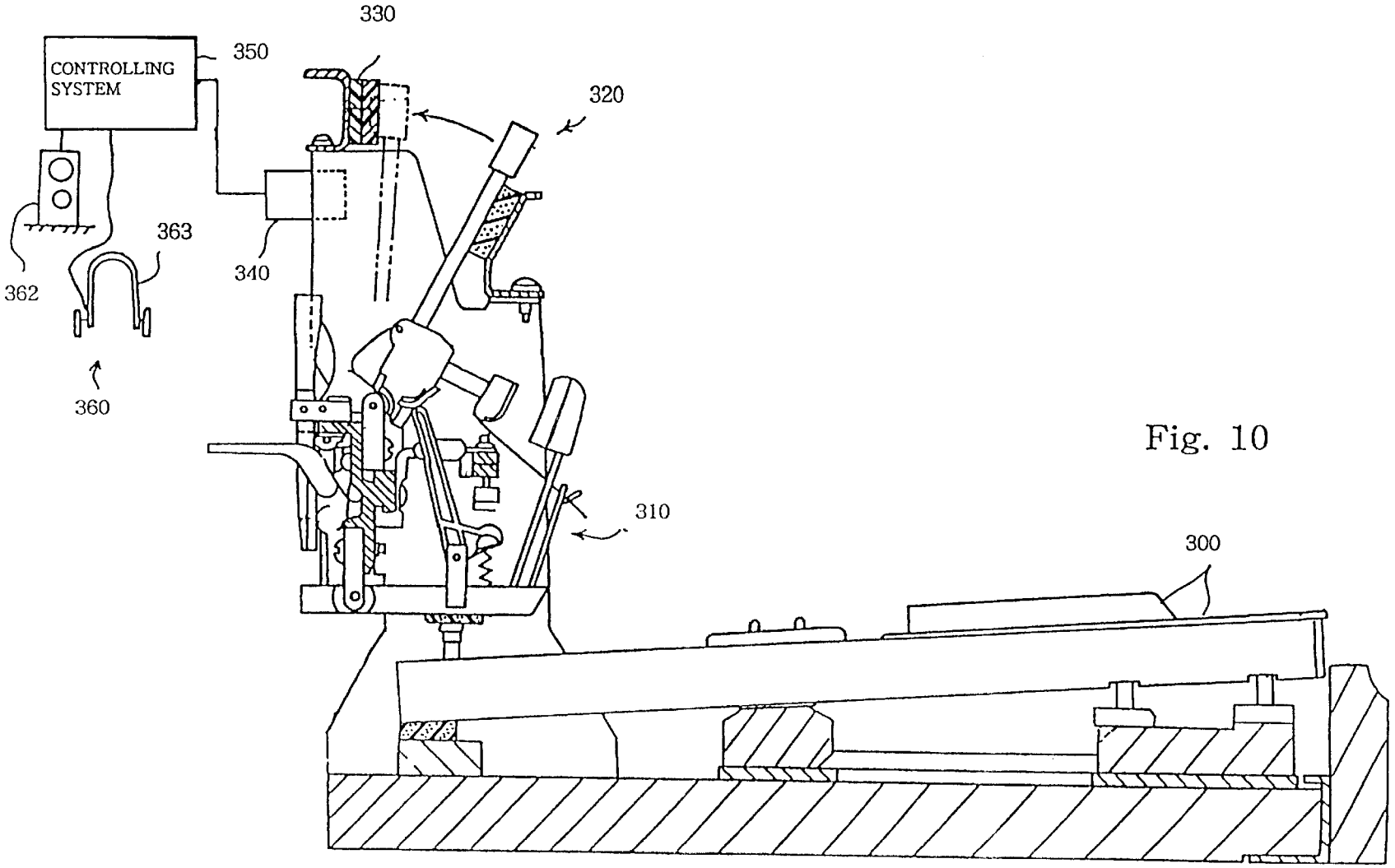
FIG. 10 is a cross sectional side view showing a keyboard musical instrument for practice use according to the present invention.

FIG. 9 illustrates the audio CD player plane. When a user touches the area "Audio CD Player", the data processing system 158 produces the audio CD player plane on the liquid crystal display panel 171, and emphasizes the area "Audio CD Player". An array of switch buttons 131, two indicators "volume" and "balance" and a display window 132 are produced in the audio CD player plane. The inject button, the start button, stop button, fast move buttons and select buttons form the array 131. The indicators "volume" and "balance" are similar to those of the disklavier/performance panels. The total number of tunes stored in the compact disk CD, the position of the presently reproduced tune and the lapse of time are shown in the display window 132. The display window 132 shown in FIG. 9 teaches that sixteen tunes are stored in the compact disk and that the first tune is to be reproduced (see "1/16". The lapse of time is zero (see "00:00").

Thus, the user registers the pieces of status in the hard disk driver 183. After the registration, the user quickly establishes the status in the hybrid keyboard musical instrument by selectively manipulating the registration buttons "A" to "M". Thus, the user can change the status in the performance. Of course, the user can change the piece of status information already stored in the hard disk unit 183.

As will be appreciated from the foregoing description, the user has selected the sound source, i.e., the music strings 117, the piano tone generator 151 and the general tone generator 152 and determined the parameters for the electronic tones before performance. After the registration of the pieces of status information each representative of the selected sound source and the parameters, the user starts to play a tune on the keyboard 111. Whenever the user wants to change the sound source and the parameters, the user simply touches the registration button. Then, the data processing system 158 quickly changes the sound source and the parameter. Thus, the user is free from complicated manipulation on the user interface.

In the above-described embodiment, the action mechanisms 114, the hammers 115 and the music strings 117 as a whole constitute one of the plural sound generating sources, and the combination of the piano tone generator 151 and the sound system 154 and the combination of the general tone generator 152 and the sound system 154 serve as others of the plural sound generating sources. The solenoid-operated key actuators 141, the action mechanisms 114, the hammers 115 and the music strings 117 serve as another of the plural sound generating sources.

The keyboard 111 and the key sensors 160 as a whole constitute a data source. The compact disk CD, the disk driver unit 161, the data processing system 158 and the host controller 157 serve as another kind of data source.

The hard disk unit 183 is corresponding to the data storage. The data processing system 158, the user interface 105 and the set of video data codes representative of the performance panel serve as a registrar. The registration buttons "A" to "M", the data processing system 158, the host controller 157, the silent system 103 and the set of video data codes as a whole constitute the recalling means. The host controller 157 and the silent system 103 as a whole constitute a status changer.

Although particular embodiments of the present invention have been shown and described, it will be apparent to those skilled in the art that various changes and modifications may be made without departing from the spirit and scope of the present invention.

For example, the data processing system 107 may be installed inside the piano case.

The front board 193 and the rear board 194 may be opened and closed by means of actuators 280/281 such as, for example, electric motors, a hydraulic system or a suitable link mechanism driven by solenoid-operated actuators. In this instance, the positions of the front/rear boards 193/194 may be registered together with the free/blocking positions. Of course, only the status of the front/rear board 193/194 may be registered together with the parameters.

Another keyboard musical instrument according to the present invention may be equipped with pedal actuators. In this instance, the pedal positions may be registered together with the free/blocking positions.

The hammer stopper of yet another keyboard musical instrument according to the present invention may be changed among the free position FP, the blocking, position BP and a mute position. When the hammer stopper is changed to the mute position, the hammers softly strikes the associated music strings so as to lower the loudness of the acoustic piano tones. In this instance, the user can register the mute position.

The present invention is applicable to still another keyboard musical instrument having, more than one tone generator. Although the keyboard musical instrument includes a keyboard 310, action mechanisms 310 and dummy hammers 320, any music string is not incorporated therein, and a shock absorber 330 is struck with the dummy hammers 320. The hammer motions are monitored by suitable sensors 340 such as, for example, photo-couplers, and a controlling system 350 produces digital music data codes from electric signals output from the sensors 340. The music data codes are selectively supplied to the more than one tone generator, and analog audio signals are produced from the music data codes. The analog audio signals are supplied to a sound system 360, and electronic tones are produced through a speaker system 362 and/or a headphone 363. In this instance, the data storage, the register and the recalling means are incorporated in the keyboard musical instrument as similar to the above-described embodiment, and the user changes the sound source between the more than two tone generators and the parameters for the electronic tones from one set to another. Using the keyboard musical instrument, a beginner practices the fingering on the keyboard 300 without any acoustic piano tone.

In the above-described embodiment, both of the sound source and the parameters for the electronic tones are registered. Only the sound source may be registered.

More than two tone generators may be incorporated in the electric sound generating system 104. In this instance, the parameters of the second general tone generator are also registered through a performance panel. Otherwise, the electric sound generating system 104 may have the general tone generator only. The parameters for the electronic tones are registered for the general tone generator together with the position of the hammer stopper.

A MIDI interface port may be incorporated in the keyboard musical instrument. In this instance, the MIDI music data codes are supplied through the MIDI interface port to an external electric musical instrument, and the data processing system supplies the pieces of status information to the external electric musical instrument.

The register buttons "A" to "M" may be implemented by an array of discrete switch buttons. Otherwise, the user may manipulate the register buttons through the microphone 173. Another kind of parameters such as, for example, "mute" may be registered for the electronic tones.

The pieces of status information may be prepared by a system designer. In this instance, the pieces of status information are stored from a suitable information storage medium or a communication line to the data processing, system 158, and the user is released from the complicated registration work.

The acoustic piano may be an upright piano.

The pieces of status information registered in the hard disk unit may be available for an ensemble between a human player and the electric sound generating system 104 or between the automatic playing system 101 and the electronic sound generating system 104. In this instance, the MIDI music data codes are supplied to both of the automatic playing system 101 and the electric sound generating system 104. In the ensemble between the human player and the electric sound generating system 104, a music score and the memory for storing the MIDI music data codes as a whole constitute a data source.

What is claimed is:

1. A musical instrument comprising:

plural sound generating sources each independently activated for producing tones from pieces of music data information and deactivated for not producing said tones, each of the combinations of the activated sound generating sources establishing said musical instrument in one of different kinds of status, a data source producing said pieces of music data information available for producing tones through each of said plural sound generating sources, a data storage having plural storage areas, a register producing pieces of status information representative of said different kinds of status, respectively, and connected to said data storage for storing said pieces of status information in said plural storage areas, respectively, and a recalling means having plural manipulators respectively representative of said pieces of status information stored in said data storage and establishing said musical instrument in each of said different kinds of status when an associated one of said plural manipulators is manipulated.

2. The musical instrument as set forth in claim 1, in which at least one of said plural sound generating sources produces said tones through vibrations physically produced in a member, and another of said plural sound generating sources produces said tones from an electric signals.

3. The musical instrument as set forth in claim 2, in which said at least one of said plural sound generating sources includes action mechanisms linked with a keyboard, hammers driven for rotation by said action mechanisms and music strings respectively struck with said hammers for producing said vibrations.

4. The music instrument as set forth in claim 3, in which said keyboard serves as said data source so that a fingering on said keyboard represents said pieces of music data information.

5. The musical instrument as set forth in claim 2, in which said another of said plural sound generating sources includes a data processing system for producing music data codes from status signals a first tone generator for producing a first audio signal from said music data codes and a sound system for producing said tones from said first audio signal.

6. The musical instrument as set forth in claim 5, in which yet another of said plural sound generating sources includes said data processing system, a second tone generator for producing a second audio signal from said music data codes and said sound system for further producing said tones from said second audio signal.

7. The musical instrument as set forth in claim 6, in which said first tone generator and said second tone generator respectively impart a first timbre fixed thereto and a second timbre variable depending upon said piece of status information.

8. The musical instrument as set forth in claim 7, in which one of said pieces of status information represents the combination containing said yet another sound generating source and said second timbre.

9. A musical instrument comprising:

plural sound generating sources each independently activated for producing tones from pieces of music data information and deactivated for not producing said tones, each of the combinations of the activated sound generating sources establishing said musical instrument in one of different kinds of status, a data source producing said pieces of music data information available for producing tones through each of said plural sound generating sources, a data storage having plural storage areas, a register producing pieces of status information representative of said different kinds of status, respectively, and connected to said data storage for storing said pieces of status information in said plural storage areas, respectively, a recalling means having plural manipulators respectively representative of said pieces of status information stored in said data storage and establishing said musical instrument in each of said different kinds of status when an associated one of said plural manipulators is manipulated, in which at least one of said plural sound generating sources produces said tones through vibrations physically produced in a member, and another of said plural sound generating sources produces said tones from an electric signals, in which said another of said plural sound generating sources includes a data processing system for producing music data codes from status signals, a first tone generator for producing a first audio signal from said music data codes and a sound system for producing said tones from said first audio signal, and in which said status signals are supplied from plural key sensors respectively associated with keys, and said key sensors and said plural keys serve as said data source.

10. The musical instrument as set forth in claim 5, in which at least one of said pieces of status information represents at least one attribute of said tones produced by said sound source together with one of said different kinds of status.

11. The musical instrument as set forth in claim 1, in which one if said plural sound generating sources includes action mechanisms linked with a keyboard, hammers driven for rotation by said action mechanisms and music strings respectively struck with said hammers for generating said tones, and another of said plural sound generating sources includes a data processing system for producing music data codes from status signals, a first tone generator for producing a first audio signal from said music data codes and a sound system for producing said tones from said first audio signal.

12. The musical instrument as set forth in claim 11, in which yet another of said plural sound generating sources includes said data processing system, a second tone generator for producing, a second audio signal from said music data codes and said sound system for producing said tones from said second audio signal.

13. The musical instrument as set forth in claim 11, in which said data source includes a keyboard having plural keys independently moved and key sensors respectively associated with said plural keys for producing said status signals.

14. The music instrument as set forth in claim 11, in which said keyboard selectively actuates said action mechanisms so as to cause said music strings to produce said tones when selected one of said pieces of status information represents the combination containing said one of said plural sound generating sources, and said data processing system supplies said music data codes produced from said status signals to said first tone generator so as to cause said sound system to produce said tone when selected one of said pieces of status information represents the combination containing said another of said plural sound generating sources.

15. The musical instrument as set forth in claim 11, in which said hammers rebound on said music strings for vibrating said music strings when said one of said plural sound generating sources is activated, said hammers rebound on a hammer stopper of said recalling means for keeping, said music strings silent when said one of said plural sound generating sources is deactivated.

16. The musical instrument as set forth in claim 11, in which at least one of said pieces of status information represents a relative loudness between plural pitched parts of said tones to be generated by said music strings together with the combinations containing said one of said plural sound generating sources.

17. The musical instrument as set forth in claim 16, in which said relative loudness is varied by changing a split top board opening or closing a case where said one of said plural sound generating sources is accommodated.

18. The musical instrument as set forth in claim 1, in which registrar includes a user interface manipulated by a user and a data processing system connected between said user interface and said data storage and producing said pieces of status information one the basis of instructions of said user given through said user interface.

19. A musical instrument comprising:

plural sound generating sources each independently activated for producing tones from pieces of music data information and deactivated for not producing said tones, each of the combinations of the activated sound generating sources establishing said musical instrument in one of different kinds of status, a data source producing said pieces of music data information available for producing tones through each of said plural sound generating sources, a data storage having plural storage areas, a register producing pieces of status information representative of said different kinds of status, respectively, and connected to said data storage for storing said pieces of status information in said plural storage areas, respectively, a recalling means having plural manipulators respectively representative of said pieces of status information stored in said data storage and establishing said musical instrument in each of said different kinds of status when an associated one of said plural manipulators is manipulated, in which register includes a user interface manipulated by a user and a data processing system connected between said user interface and said data storage and producing said pieces of status information one the basis of instructions of said user given through said user interface, and in which said user interface includes a display having a screen and connected to said data processing system for producing images of manipulators and a touch panel connected to said data processing system and overlapped with said screen for transferring said instructions to said data processing system on the basis of the images manipulated by said user.

20. A musical instrument comprising:

plural sound generating sources each independently activated for producing tones from pieces of music data information and deactivated for not producing said tones, each of the combinations of the activated sound generating sources establishing said musical instrument in one of different kinds of status, a data source producing said pieces of music data information available for producing tones through each of said plural sound generating sources, a data storage having plural storage areas, a register producing pieces of status information representative of said different kinds of status, respectively, and connected to said data storage for storing said pieces of status information in said plural storage areas, respectively, a recalling means having plural manipulators respectively representative of said pieces of status information stored in said data storage and establishing said musical instrument in each of said different kinds of status when an associated one of said plural manipulators is manipulated, in which register includes a user interface manipulated by a user and a data processing system connected between said user interface and said data storage and producing said pieces of status information one the basis of instructions of said user given through said user interface, in which said user interface includes a display having a screen and connected to said data processing system for producing images of manipulators and a touch panel connected to said data processing system and overlapped with said screen for transferring said instructions to said data processing system on the basis of the images manipulated by said user, and in which the image of one of said manipulators represents one of said combinations of said plural sound generating sources.

21. A musical instrument comprising:

plural sound generating sources each independently activated for producing tones from pieces of music data information and deactivated for not producing said tones, each of the combinations of the activated sound generating sources establishing said musical instrument in one of different kinds of status, a data source producing said pieces of music data information available for producing tones through each of said plural sound generating sources, a data storage having plural storage areas, a register producing pieces of status information representative of said different kinds of status, respectively, and connected to said data storage for storing said pieces of status information in said plural storage areas, respectively, a recalling means having plural manipulators respectively representative of said pieces of status information stored in said data storage and establishing said musical instrument in each of said different kinds of status when an associated one of said plural manipulators is manipulated, in which register includes a user interface manipulated by a user and a data processing system connected between said user interface and said data storage and producing said pieces of status information one the basis of instructions of said user given through said user interface, in which said user interface includes a display having a screen and connected to said data processing system for producing images of manipulators and a touch panel connected to said data processing system and overlapped with said screen for transferring said instructions to said data processing system on the basis of the images manipulated by said user, in which the image of one of said manipulators represents one of said combinations of said plural sound generating sources, and the image of another of said manipulators represents at least one attribute of said tones.

22. A musical instrument comprising:

plural sound generating sources each independently activated for producing tones from pieces of music data information and deactivated for not producing said tones, each of the combinations of the activated sound generating sources establishing said musical instrument in one of different kinds of status, a data source producing said pieces of music data information available for producing tones through each of said plural sound generating sources, a data storage having plural storage areas, a register producing pieces of status information representative of said different kinds of status, respectively, and connected to said data storage for storing said pieces of status information in said plural storage areas, respectively, a recalling means having plural manipulators respectively representative of said pieces of status information stored in said data storage and establishing said musical instrument in each of said different kinds of status when an associated one of said plural manipulators is manipulated, and in which said recalling means includes a user interface manipulated by a user, a status changer connected to said plural sound generating sources and a data processing system connected to said user interface, said status changer and said data storage and instructing said status changer to selectively activate and deactivate said plural sound generating sources on the basis of one of said pieces of status information selected through said user interface by said user.

23. A musical instrument comprising:

plural sound generating sources each independently activated for producing tones from pieces of music data information and deactivated for not producing said tones, each of the combinations of the activated sound generating sources establishing said musical instrument in one of different kinds of status, a data source producing said pieces of music data information available for producing tones through each of said plural sound generating sources, a data storage having plural storage areas, a register producing pieces of status information representative of said different kinds of status, respectively, and connected to said data storage for storing said pieces of status information in said plural storage areas, respectively, a recalling means having plural manipulators respectively representative of said pieces of status information stored in said data storage and establishing said musical instrument in each of said different kinds of status when an associated one of said plural manipulators is manipulated, in which said recalling means includes a user interface manipulated by a user, a status changer connected to said plural sound generating sources and a data processing system connected to said user interface, said status changer and said data storage and instructing said status changer to selectively activate and deactivate said plural sound generating sources on the basis of one of said pieces of status information selected through said user interface by said user, and in which said user interface includes a display having a screen and connected to said data processing system for producing images of manipulators and a touch panel connected to said data processing system and overlapped with said screen for notifying the selection of said user to said data processing system on the basis of the images manipulated by said user.

* * * * *